US009825362B2

(12) United States Patent
Lee et al.

(10) Patent No.: US 9,825,362 B2
(45) Date of Patent: Nov. 21, 2017

(54) ANTENNA STRUCTURE AND WIRELESS COMMUNICATION DEVICE USING THE ANTENNA STRUCTURE

(71) Applicant: Chiun Mai Communication Systems, Inc., New Taipei (TW)

(72) Inventors: Yi-Chieh Lee, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 248 days.

(21) Appl. No.: 14/555,534

(22) Filed: Nov. 26, 2014

(65) Prior Publication Data

US 2015/0155633 A1 Jun. 4, 2015

(30) Foreign Application Priority Data

Nov. 30, 2013 (CN) ..... 2013 1 0622350

(51) Int. Cl.

| | |
|---|---|
| ***H01Q 1/24*** | (2006.01) |
| ***H01Q 5/371*** | (2015.01) |
| ***H01Q 9/42*** | (2006.01) |
| ***H01Q 5/50*** | (2015.01) |

(52) U.S. Cl.
CPC ..... *H01Q 5/371* (2015.01); *H01Q 1/243* (2013.01); *H01Q 5/50* (2015.01); *H01Q 9/42* (2013.01)

(58) Field of Classification Search
CPC ..... H01Q 5/371; H01Q 1/243; H01Q 5/50; H01Q 9/42
USPC ..... 343/702, 833, 846
See application file for complete search history.

(56) References Cited

U.S. PATENT DOCUMENTS

| | | | | |
|---|---|---|---|---|
| 6,429,818 B1 * | 8/2002 | Johnson | ..... | H01Q 1/243 343/700 MS |
| 2007/0109202 A1 * | 5/2007 | Vance | ..... | H01Q 1/243 343/702 |

* cited by examiner

*Primary Examiner* — Huedung Mancuso
(74) *Attorney, Agent, or Firm* — Steven Reiss

(57) ABSTRACT

An antenna structure includes a feed portion, a ground portion, a connecting portion, a first radiating portion, a second radiating portion, and a resonance portion. The ground portion is spaced apart from the feed portion. The connecting portion is electrically connected to the feed portion. The first radiating portion and the second radiating portion are both electrically connected to the connecting portion. The resonance portion is electrically connected to the ground portion. The connecting portion and the resonance portion define a slot therebetween.

19 Claims, 5 Drawing Sheets

ANTENNA STRUCTURE AND WIRELESS COMMUNICATION DEVICE USING THE ANTENNA STRUCTURE

FIELD

The subject matter herein generally relates to an antenna structure and a wireless communication device using the antenna structure.

BACKGROUND

Antennas are important elements of wireless communication devices, such as mobile phones or personal digital assistants. Many wireless communication devices further employ metal housings for improving heat dissipation or other purposes.

BRIEF DESCRIPTION OF THE DRAWINGS

Implementations of the present technology will now be described, by way of example only, with reference to the attached figures.

DETAILED DESCRIPTION

Figure 1:
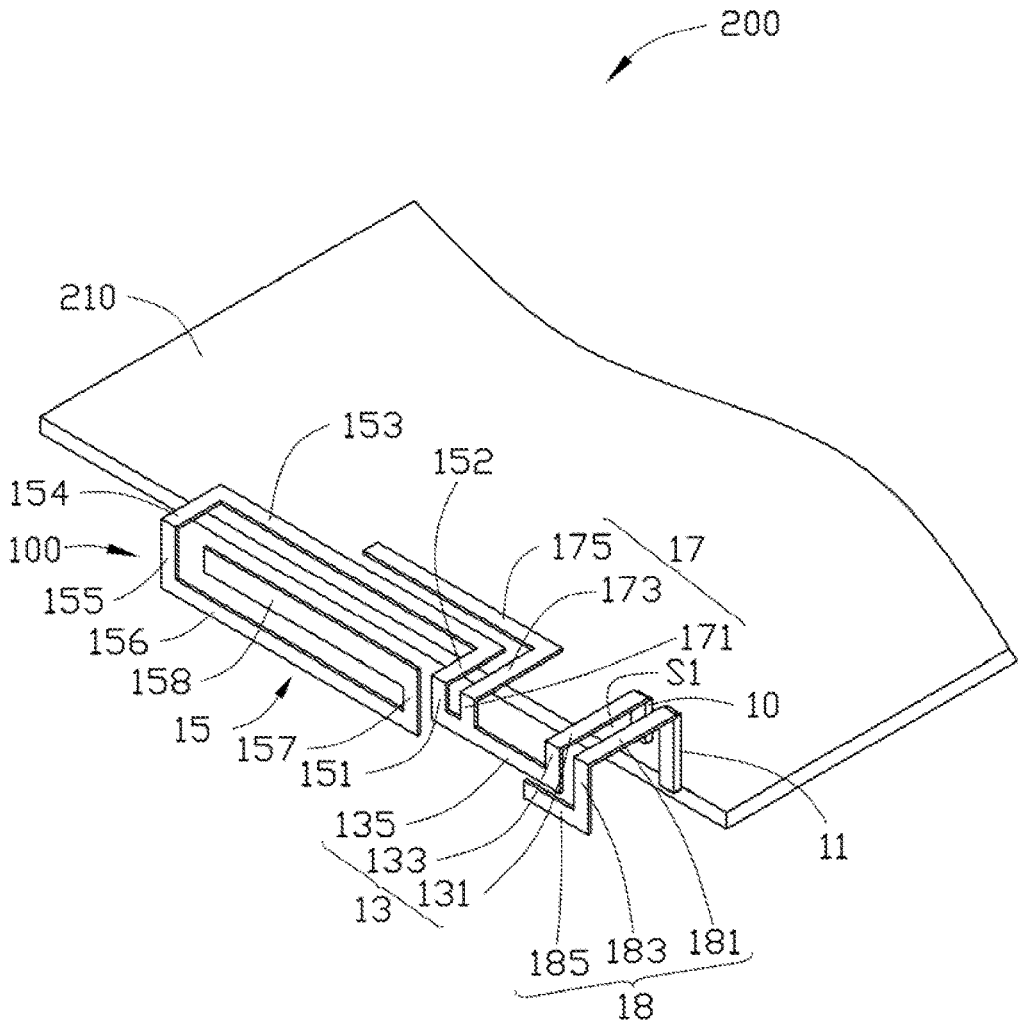
FIG. 1 is an isometric view of a first embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates a first embodiment of a wireless communication device 200. The wireless communication device

200 may be a mobile phone or a personal digital assistant, for example. The wireless communication device 200 includes a base board 210 and an antenna structure 100 mounted on the base board 210. In this embodiment, the base board 210 is a circuit board of the wireless communication device 200.

The antenna structure 100 includes a feed portion 10, a grounding portion 11, a connecting portion 13, a first radiating portion 15, a second radiating portion 17, and a resonance portion 18. The connecting portion 13 is electronically connected to the feed portion 10. The first radiating portion 15 and the second radiating portion 17 are both electronically connected to the connecting portion 13. The resonance portion 18 is electronically connected to the ground portion 11 and is spaced apart from the connecting portion 13. Thus, a slot S1 is defined between the connecting portion 13 and the resonance portion 18.

In this embodiment, the feed portion 10 and the ground portion 11 are both longitudinal planar sheets. The feed portion 10 is positioned at a plane perpendicular to a plane that the base board 210 is positioned. The feed portion 10 is electronically connected to a feed point (not shown) of the base board 210 and is configured to feed current to the antenna structure 100. The ground portion 11 is positioned at a plane perpendicular to a plane that the base board 210 is positioned. The ground portion 11 is electronically connected to a ground point (not shown) of the base board 210 and is configured to ground the antenna structure 100.

The connecting portion 13 includes a first connecting section 131, a second connecting section 133, and a third connecting section 135 connected in order. The first connecting section 131 is substantially a strip and is positioned at a plane parallel to the plane that the base board 210 is positioned. The first connecting section 131 is perpendicularly connected to an end of the feed portion 10 away from the base board 210. The second connecting section 133 is substantially a strip and is positioned at a plane parallel to the plane that the feed portion 10 is positioned. The second connecting section 133 is perpendicularly connected to an end of the first connecting section 131 away from the feed portion 10. The third connecting section 135 is substantially a strip and is coplanar with the second connecting section 133. The third connecting section 135 is perpendicularly connected to an end of the second connecting section 133 away from the first connecting section 131 to form an L-shaped structure with the second connecting section 133.

The first radiating portion 15 includes a first radiating section 151, a second section 152, a third radiating section 153, a fourth radiating section 154, a fifth radiating section 155, a sixth radiating section 156, a seventh radiating section 157, and an eighth radiating section 158 connected in order. The first radiating section 151 is substantially a strip and is coplanar with the second connecting section 133. The first radiating section 151 is perpendicularly connected to an end of the third connecting section 135 away from the second connecting section 133. In this embodiment, the first radiating section 151 and the second connecting section 133 are parallel to each other and are positioned at a same side of the third connecting section 135.

The second radiating section 152 is positioned at a plane that the first connecting section 131 is positioned. The second radiating section 152 is perpendicularly connected to an end of the first radiating section 151 away from the third connecting section 135. The third radiating section 153 and the fourth radiating section 154 are coplanar with the second radiating section 152 and form a U-shaped structure with the second radiating section 152. In detail, the third radiating section 153 has a first end perpendicularly connected to an end of the second radiating section 152 away from the first radiating section 151 and a second end perpendicularly connected to the fourth radiating section 154.

The fifth to eighth radiating sections 155-158 are positioned at a plane parallel to the plane that the feed portion 10 is positioned and cooperatively form a loop structure. The fifth radiating section 155 is perpendicularly connected to an end of the fourth radiating section 154 away from the third radiating section 153. The sixth radiating section 156 is perpendicularly connected to an end of the fifth radiating section 155 away from the fourth radiating section 154 and extends towards the connecting portion 13. The seventh radiating section 157 is perpendicularly connected to an end of the sixth radiating section 156 away from the fifth radiating section 155 and extends towards the second radiating section 152. The eight radiating section 158 is perpendicularly connected to an end of the seventh radiating section 157 away from the sixth radiating section 156 and extends towards the fifth radiating section 155.

The second radiating portion 17 is positioned between the connecting portion 13 and the first radiating portion 15 and includes a first extending section 171, a second extending section 173, and a third extending section 175 connected in order. The first extending section 171 is substantially a strip and is coplanar with the second connecting section 133. The first extending section 171 is perpendicularly connected to a side of the third connecting section 135 and is positioned between the second connecting section 133 and the first radiating section 151. The second extending section 173 is coplanar with and parallel to the second radiating section 152. The second extending section 173 is perpendicularly connected to an end of the first extending section 171 away from the third connecting section 135. The third extending section 173 is coplanar with and parallel to the third radiating section 153. The third extending section 175 is perpendicularly connected to an end of the second extending section 173 away from the first radiating section 171. In this embodiment, a length of the third extending section 175 is less than a length of the third radiating section 153.

The resonance portion 18 has a similar structure with the connecting portion 13 and includes a first resonance section 181, a second resonance section 183, and a third resonance section 185 connected in order. The first resonance section 181 is substantially a strip. The first resonance section 181 is coplanar with and parallel to the first connecting section 131. The first resonance section 181 is perpendicularly connected to an end of the ground portion 11. The second resonance section 183 and the third resonance section 185 are positioned at a plane that the second connecting section 133 is positioned. The second resonance section 183 is perpendicularly connected to an end of the first resonance section 181 away from the ground portion 11 and extends along a direction parallel to the second connecting section 133. The third resonance section 185 is perpendicularly connected to a distal end of the second resonance section 183 and extends along a direction parallel to the third connecting section 135 and towards the seventh radiating section 157.

Due to the slot S1 is defined between the connecting portion 13 and the resonance portion 18, when the current from the feed portion 10 flows through the connecting portion 13, the current is coupled to the resonance portion 18, and is further grounded by the ground point of the base board 210 via the ground portion 11. By adjusting a width of the slot S1, an impedance of the antenna structure 100 can be matched for adjusting a high-frequency bandwidth of the antenna structure 100.

Figure 2:
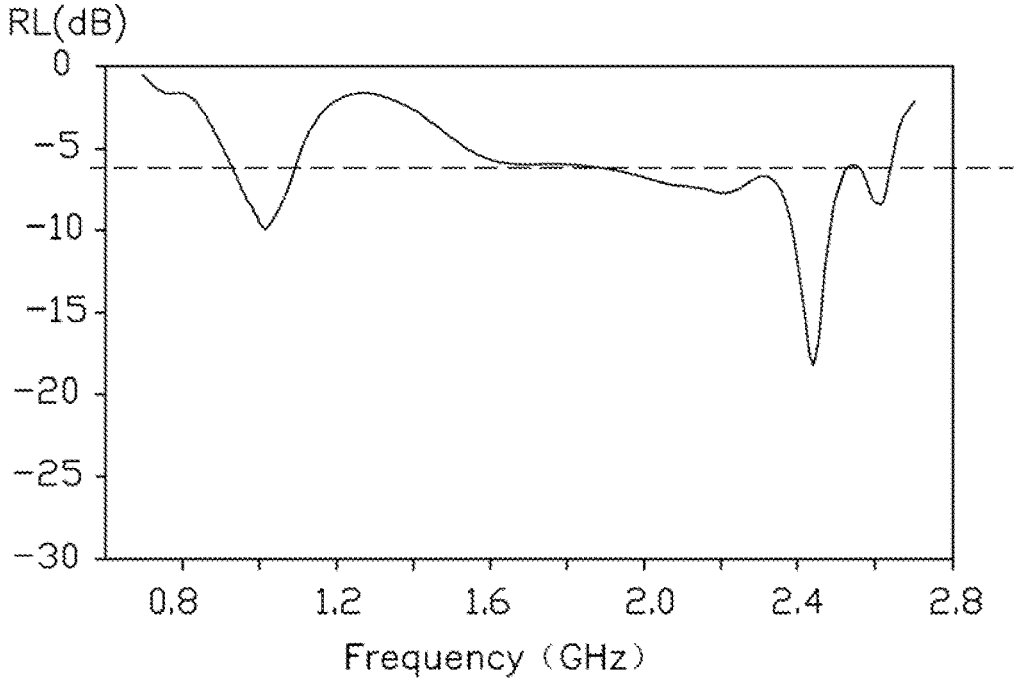
FIG. 2 is a return loss (RL) graph of the antenna structure of the wireless communication device of FIG. 1.

As illustrated, when the antenna structure 100 works, the first radiating portion 15 activates a first resonance mode. The first radiating portion 15 and the second radiating portion 17 further cooperatively activate a second resonance mode, a third resonance mode, and a fourth resonance mode. FIG. 2 illustrates a return loss (RL) graph of the antenna structure 100. Evidentially, when the antenna structure 100 works at the four resonance modes, the RL of the antenna structure 100 is all less than −6 dB, and satisfies radiation requirements.

Figure 3:
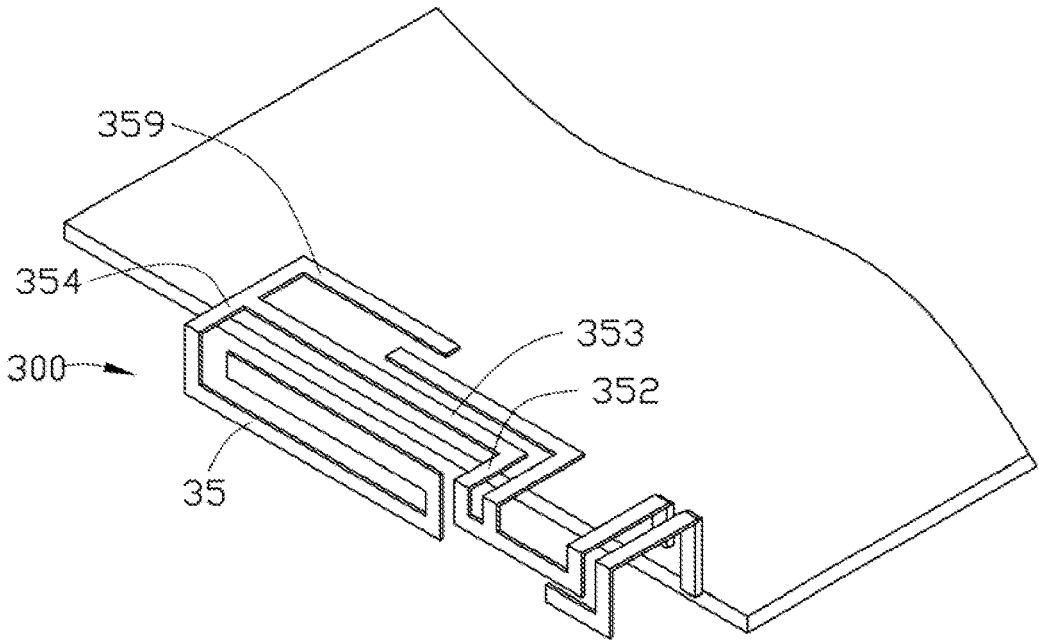
FIG. 3 is an isometric view of a second embodiment of a wireless communication device.

FIG. 3 illustrates a second embodiment of an antenna structure 300 including a first radiating portion 35. The first radiating portion 35 differs from the antenna structure 100 in that the first radiating portion 35 further includes a ninth radiating section 359 to broaden a high-frequency band of the antenna structure 300. The ninth radiating section 359 is substantially an L-shaped sheet. The ninth radiating section 359 is perpendicularly connected to a joint of the third radiating section 353 and the fourth radiating section 354 to be collinear with the fourth radiating section 354, and then extends along a direction parallel to the third radiating section 353 and towards the second radiating section 352.

Figure 4:
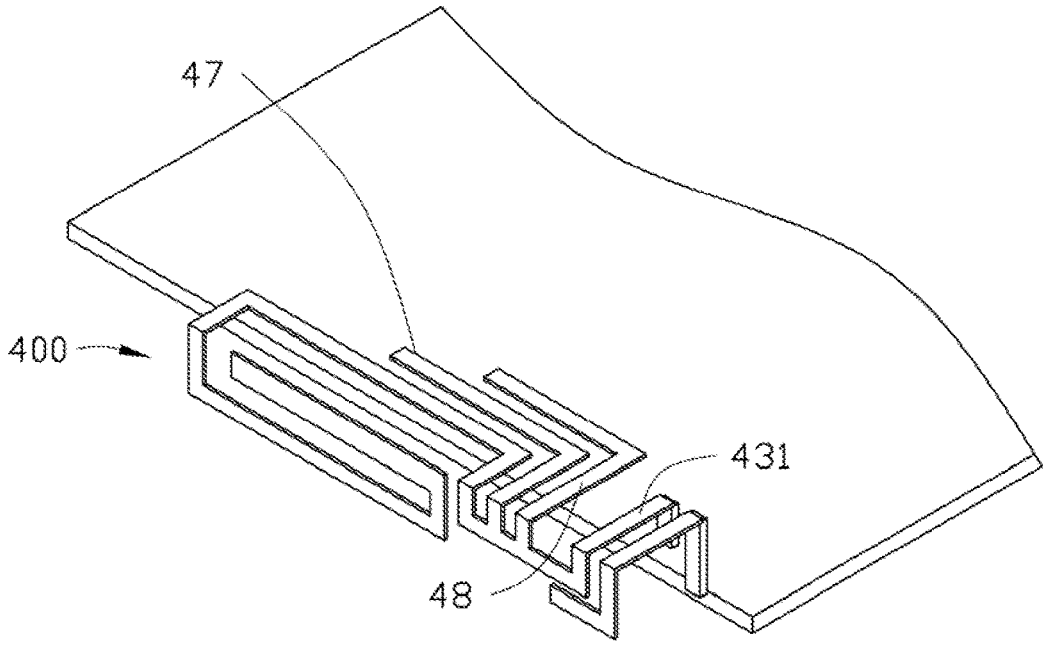
FIG. 4 is an isometric view of a third embodiment of a wireless communication device.

FIG. 4 illustrates a third embodiment of an antenna structure 400, differing from the antenna structure 100 in that the antenna structure 400 further includes a third radiating portion 48. The third radiating portion 48 has a same structure with the second radiating portion 47 and is positioned between the second radiating portion 47 and the first connecting section 431.

Figure 5:
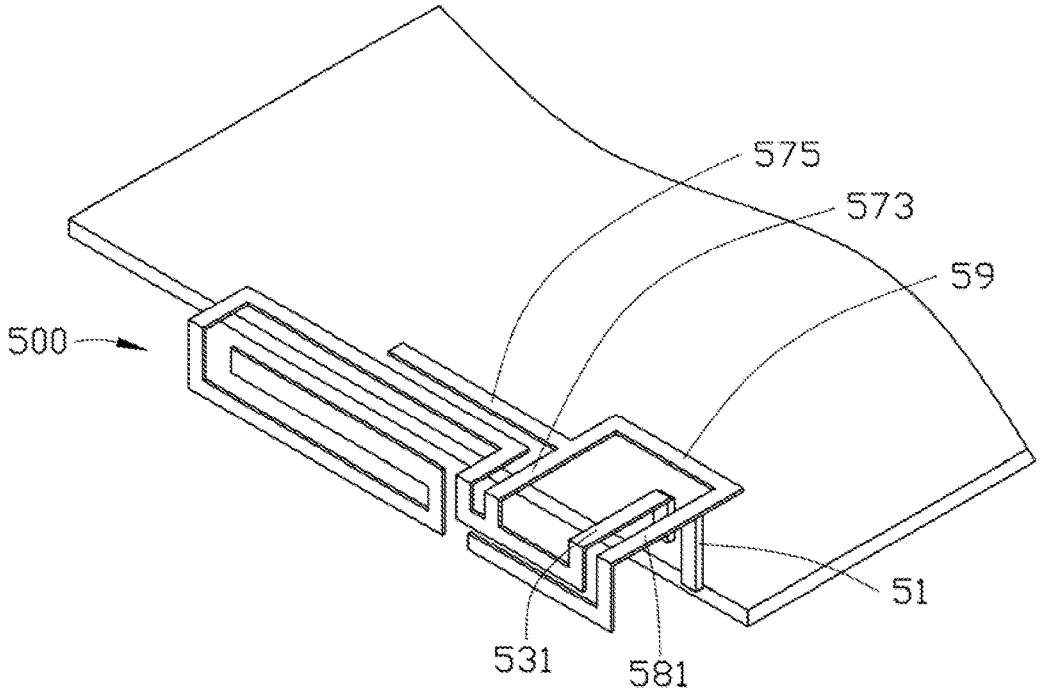
FIG. 5 is an isometric view of a fourth embodiment of a wireless communication device.

FIG. 5 illustrates a fourth embodiment of an antenna structure 500, differing from the antenna structure 100 in that the antenna structure 500 further includes a coupling portion 59. The coupling portion 59 is substantially a U-shaped sheet and is coplanar with the first connecting section 531. A first end of the coupling portion 59 is electronically connected to a joint of the second extending section 573 and the third extending section 575. A second end of the coupling portion 59 is electronically connected to a joint of the first resonance section 581 and the ground portion 51.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a feed portion;

a ground portion spaced apart from the feed portion;

a connecting portion electrically connected to the feed portion and comprising a first connecting section, a second connecting section, and a third connecting section, the first connecting section perpendicularly connected to an end of the feed portion, the second connecting section perpendicularly connected to an end of the first connecting section away from the feed portion, the third connecting section perpendicularly connected to an end of the second connecting section away from the first connecting section;

a first radiating portion electrically connected to the connecting portion;

a second radiating portion electrically connected to the connecting portion; and a resonance portion electronically connected to the ground portion;

wherein the resonance portion is spaced apart from the connecting portion and the connecting portion and the resonance portion define a slot therebetween such that when a current from the feed portion flows through the connecting portion, the current is coupled to the resonance portion; and wherein the first radiating portion comprises a first radiating section, a second section, a third radiating section, and a fourth radiating section; the first radiating section is coplanar with the second connecting section and is perpendicularly connected to an end of the third connecting section away from the second connecting section; the second radiating section is positioned at a plane that the first connecting section is positioned and is perpendicularly connected to an end of the first radiating section away from the third connecting section; the third radiating section and the fourth radiating section are coplanar with the second radiating section and form a U-shaped structure with the second radiating section.

2. The antenna structure of claim 1, wherein the third connecting section is coplanar with the second connecting section.

3. The antenna structure of claim 1, wherein the first radiating portion further comprises a fifth radiating section, a sixth radiating section, a seventh radiating section, and an eighth radiating section, the fifth to eighth radiating sections are positioned at a plane parallel to the plane that the feed portion is positioned and cooperatively form a loop structure.

4. The antenna structure of claim 3, wherein the fifth radiating section is perpendicularly connected to an end of the fourth radiating section away from the third radiating section; the sixth radiating section is perpendicularly connected to an end of the fifth radiating section away from the fourth radiating section and extends towards the connecting portion; the seventh radiating section is perpendicularly connected to an end of the sixth radiating section away from the fifth radiating section and extends towards the second radiating section; the eight radiating section is perpendicularly connected to an end of the seventh radiating section away from the sixth radiating section and extends towards the fifth radiating section.

5. The antenna structure of claim 1, wherein the first radiating portion further includes a ninth radiating section; the ninth radiating section is perpendicularly connected to a joint of the third radiating section and the fourth radiating section to be collinear with the fourth radiating section, and then extends along a direction parallel to the third radiating section and towards the second radiating section.

6. The antenna structure of claim 1, wherein the second radiating portion comprises a first extending section, a second extending section, and a third extending section, the first extending section is perpendicularly connected to a side of the third connecting section and is positioned between the second connecting section and the first radiating section; the second extending section is coplanar with and parallel to the second radiating section, and is perpendicularly connected to an end of the first extending section away from the third connecting section; the third extending section is coplanar with and parallel to the third radiating section, and is perpendicularly connected to an end of the second extending section away from the first radiating section.

7. The antenna structure of claim 6, wherein the resonance portion comprises a first resonance section, a second resonance section, and a third resonance section; the first resonance section is coplanar with and parallel to the first connecting section, and is perpendicularly connected to an end of the ground portion; the second resonance section is perpendicularly connected to an end of the first resonance section away from the ground portion and extends along a direction parallel to the second connecting section; the third resonance section is perpendicularly connected to a distal end of the second resonance section and extends along a direction parallel to the third connecting section.

8. The antenna structure of claim 5, wherein further comprising a third radiating portion, the third radiating portion has a same structure with the second radiating portion and is positioned between the second radiating portion and the first connecting section.

9. The antenna structure of claim 7, wherein further comprising a coupling portion, the coupling portion is substantially a U-shaped sheet and is coplanar with the first connecting section; a first end of the coupling portion is electrically connected to a joint of the second extending section and the third extending section, and a second end of the coupling portion is electrically connected to a joint of the first resonance section and the ground portion.

10. A wireless communication device comprising:

a base board; and an antenna structure comprising:

a feed portion positioned at a plane perpendicular to a plane that the base board is positioned;

a ground portion positioned at a plane perpendicular to a plane that the base board is positioned and spaced apart from the feed portion;

a connecting portion electrically connected to the feed portion and comprising a first connecting section, a second connecting section, and a third connecting section, the first connecting section perpendicularly connected to an end of the feed portion, the second connecting section perpendicularly connected to an end of the first connecting section away from the feed portion, the third connecting section perpendicularly connected to an end of the second connecting section away from the first connecting section;

a first radiating portion electrically connected to the connecting portion;

a second radiating portion electrically connected to the connecting portion; and a resonance portion electronically connected to the ground portion and the connecting portion and the resonance portion defining a slot therebetween;

wherein the first radiating portion comprises a first radiating section, a second section, a third radiating section, and a fourth radiating section; the first radiating section is coplanar with the second connecting section and is perpendicularly connected to an end of the third connecting section away from the second connecting section; the second radiating section is positioned at a plane that the first connecting section is positioned and is perpendicularly connected to an end of the first radiating section away from the third connecting section; the third radiating section and the fourth radiating section are coplanar with the second radiating section and form a U-shaped structure with the second radiating section.

11. The wireless communication device of claim 10, wherein the first connecting section is positioned at a plane parallel to a plane that the base board is positioned, the second connecting section is positioned at a plane parallel to a plane that the feed portion is positioned, and the third connecting section is coplanar with the second connecting section.

12. The wireless communication device of claim 10, wherein the first radiating portion further comprises a fifth radiating section, a sixth radiating section, a seventh radiating section, and an eighth radiating section, the fifth to eighth radiating sections are positioned at a plane parallel to the plane that the feed portion is positioned and cooperatively form a loop structure.

13. The wireless communication device of claim 12, wherein the fifth radiating section is perpendicularly connected to an end of the fourth radiating section away from the third radiating section; the sixth radiating section is perpendicularly connected to an end of the fifth radiating section away from the fourth radiating section and extends towards the connecting portion; the seventh radiating section is perpendicularly connected to an end of the sixth radiating section away from the fifth radiating section and extends towards the second radiating section; the eight radiating section is perpendicularly connected to an end of the seventh radiating section away from the sixth radiating section and extends towards the fifth radiating section.

14. The wireless communication device of claim 10, wherein the first radiating portion further includes a ninth radiating section; the ninth radiating section is perpendicularly connected to a joint of the third radiating section and the fourth radiating section to be collinear with the fourth radiating section, and then extends along a direction parallel to the third radiating section and towards the second radiating section.

15. The wireless communication device of claim 10, wherein the second radiating portion comprises a first extending section, a second extending section, and a third extending section, the first extending section is perpendicularly connected to a side of the third connecting section and is positioned between the second connecting section and the first radiating section; the second extending section is coplanar with and parallel to the second radiating section, and is perpendicularly connected to an end of the first extending section away from the third connecting section; the third extending section is coplanar with and parallel to the third radiating section, and is perpendicularly connected to an end of the second extending section away from the first radiating section.

16. The wireless communication device of claim 15, wherein the resonance portion comprises a first resonance section, a second resonance section, and a third resonance section; the first resonance section is coplanar with and parallel to the first connecting section, and is perpendicularly connected to an end of the ground portion; the second resonance section is perpendicularly connected to an end of the first resonance section away from the ground portion and extends along a direction parallel to the second connecting section; the third resonance section is perpendicularly connected to a distal end of the second resonance section and extends along a direction parallel to the third connecting section.

17. The wireless communication device of claim 14, wherein further comprising a third radiating portion, the third radiating portion has a same structure with the second radiating portion and is positioned between the second radiating portion and the first connecting section.

18. The wireless communication device of claim 16, wherein further comprising a coupling portion, the coupling portion is substantially a U-shaped sheet and is coplanar with the first connecting section; a first end of the coupling portion is electrically connected to a joint of the second extending section and the third extending section, and a second end of the coupling portion is electrically connected to a joint of the first resonance section and the ground portion.

19. An antenna structure comprising:

a feed portion;

a ground portion spaced apart from the feed portion;

a connecting portion electrically connected to the feed portion and comprising a first connecting section, a second connecting section, and a third connecting section, the first connecting section perpendicularly connected to an end of the feed portion, the second connecting section perpendicularly connected to an end of the first connecting section away from the feed portion, the third connecting section perpendicularly connected to an end of the second connecting section away from the first connecting section;

a first radiating portion electrically connected to the connecting portion;

a second radiating portion electrically connected to the connecting portion; and a resonance portion electronically connected to the ground portion and the connecting portion and the resonance portion defining a slot therebetween;

wherein the first radiating portion comprises a first radiating section, a second section, a third radiating section, and a fourth radiating section; the first radiating section is coplanar with the second connecting section and is perpendicularly connected to an end of the third connecting section away from the second connecting section; the second radiating section is positioned at a plane that the first connecting section is positioned and is perpendicularly connected to an end of the first radiating section away from the third connecting section; the third radiating section and the fourth radiating section are coplanar with the second radiating section and form a U-shaped structure with the second radiating section.

* * * * *